United States Patent [19]

Butka

[11] Patent Number: 4,754,547

[45] Date of Patent: Jul. 5, 1988

[54] SAFETY RAZOR

[76] Inventor: Kemal Butka, 372 Central Park West, Apt. 20J, New York, N.Y. 10025

[21] Appl. No.: 936,705

[22] Filed: Dec. 1, 1986

[51] Int. Cl.[4] ..... B26B 19/30

[52] U.S. Cl. ..... 30/46; 30/42

[58] Field of Search ..... 30/42, 44, 46, 51, 57, 30/85

[56] References Cited

U.S. PATENT DOCUMENTS

| | | | |
|---|---|---|---|
| 1,249,021 | 12/1917 | Burke | 30/46 |
| 1,436,960 | 11/1922 | Jakubiec | 30/42 |
| 1,529,481 | 3/1925 | Gullborg | 30/46 |
| 2,003,201 | 5/1935 | Kent | 30/42 X |
| 2,137,327 | 11/1938 | Bertry | 30/46 |
| 2,568,047 | 9/1951 | Anderson | 30/46 X |
| 3,238,617 | 3/1966 | Larson | 30/42 X |

*Primary Examiner*—E. R. Kazenske
*Assistant Examiner*—Michael D. Folkerts
*Attorney, Agent, or Firm*—Michael J. Striker

[57] ABSTRACT

A safety razor comprises a handle, at least one blade, a head element arranged to carry the blade, and a rotary element arranged to rotate in response to contact with a surface to be shaven during connected with the head element so that when a user moves the handle element and therefore the element in a predetermined direction during shaving the head element and therefore the blade is displaced in a direction which is transverse to the predetermined direction in response to rotation of the rotary element.

4 Claims, 4 Drawing Sheets

SAFETY RAZOR

BACKGROUND OF THE INVENTION

The present invention relates generally to safety razors. The term "safety razor" is used here to identify such razors which are widely utilized for a personal use as opposed to barber razors and as opposed to electrical shaving razors. The present invention deals both with such safety razors which are completely disposable after use together with their handle, and also to such razors in which a blade holding cartridge is disposable and the handle can be reused.

Safety razors are widely known and used for shaving. A known safety razor is provided with at least one blade whose shaving action strictly corresponds to the direction of movement of the safety razor. When the blade is pressed against a surface to be shaven and the safety razor moved in respective direction along this surface, the blade outs the hairs by a cutting component acting only in the direction of movement of the safety razor. It is believed that this limitation can be removed to provide an improvement in the cutting action of the safety razor.

SUMMARY OF THE INVENTION

Accordingly, it is an object of the present invention to provide a safety razor which avoids the disadvantages of the prior art.

More particularly, it is an object of the present invention to provide a safety razor in which the cutting force of a blade, in addition to a component acting in the direction of movement of the safety razor, also has a component which extends transversely of the first mentioned component. so as to improve the cutting action of the blade.

In keeping with these objects and with others which will become apparent hereinafter, one feature of the present invention resides, briefly stated, in a safety razor which has a handle element, at least one blade, a head element carrying the blade, and a rotatable element arranged to rotate during shaving under the action of a frictional contact with a surface to be shaven and connected with the head element so that the head element and the blade carried thereby moves transversely to the direction of movement of the razor in response to the rotation of the rotary element.

When the safety razor is designed in accordance with the present invention, the head element and therefore the blade carried by the head element performs not only the movement which corresponds to the movement of the handle and the head imparted by a user during shaving, but also moves transversely to the direction of this movement in response to the rotation of the rotary element whose rotation is caused by the frictional contact of the rotary element with the surface to be shaven. As a result of this, the cutting force of the blade has two components, of which one component acts in direction of the movement of the head element and the blade by a user, and in a direction which is transverse to the first mentioned direction, so as to improve the cutting action.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the aooompanying drawing.

DESCRIPTION OF PREFERRED EMBODIMENTS

A safety razor in accordance with the present invention has a handle element 5 to be held by a user. The handle element shown in FIG. 1 has a handle part 5' and a transition part 5'' connected with the handle part 5' by interengaging grooves and projections. It is to be understood that the handle element can be formed not of two parts, but as a one-piece element as well.

Figure 1:
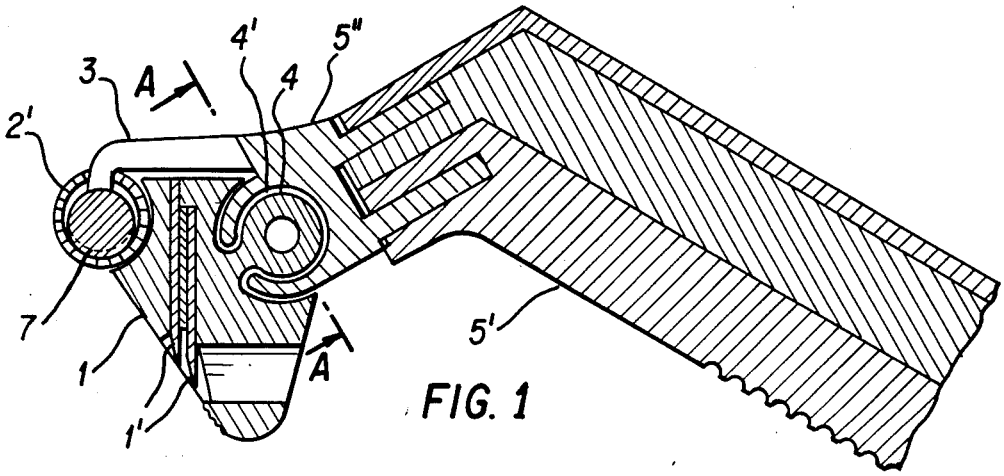
FIG. 1 is a side viewof a safety razor in accordance with the present invention, section.

The safety razor of the invention further has a head element which is identified with reference numeral 1. At least one blade is held in the head element 1. In FIG. 1 it is shown that two blades 1' are arranged in the head element 1. The blades 1' can be held fixedly and nonremovably in the head element 1. On the other hand, they can be arranged so that they can be removed from the head element 1 and replaced by new blades.

The head element 1 is connected with the handle element 5 by means of a substantially cylindrical portion 4 provided on the head element, and a complementary recess 4' provided in the handle or more particularly in its transition part 5'. The projection 4 of the head element 1 and the recess 4' of the handle 5 are formed so that the projection can be freely move in the recess in their axial direction.

The safety razor is further provided with a rotary element 2 arranged substantially in a front region of the head element 1. The rotary element 2 is cylindrical and is arranged in a complementary recess provided in the front portion of the head element 1 so that it can rotate relative to the head element 1.

The end portions of the rotary element 2 are provided with recesses 2' each accommodating a spring 6. The head element 1 has two lateral projections 1'' which are spaced from one another in an axial direction and surround the rotary element 2. Each projection 1'' has a throughgoing opening 1'''. A stepped pin 7 has a smaller portion extending into the opening 1''' of the head element 1 and a greater portion located in the recess 2' of the rotary member 2. Each pin 7 is spring-biased by the respective spring 6.

Figure 6:
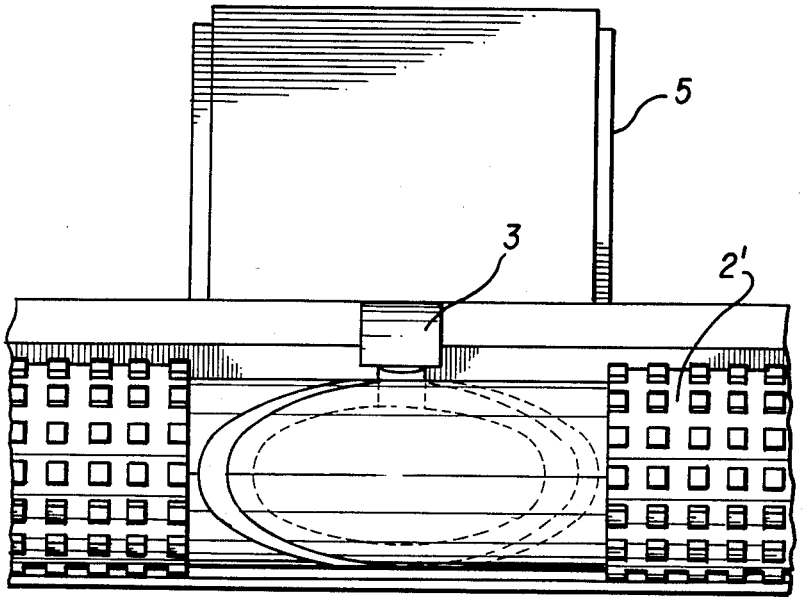
FIG. 6 is an enlarged front view of a rotary element of the inventive safety razor.
Figure 7A:
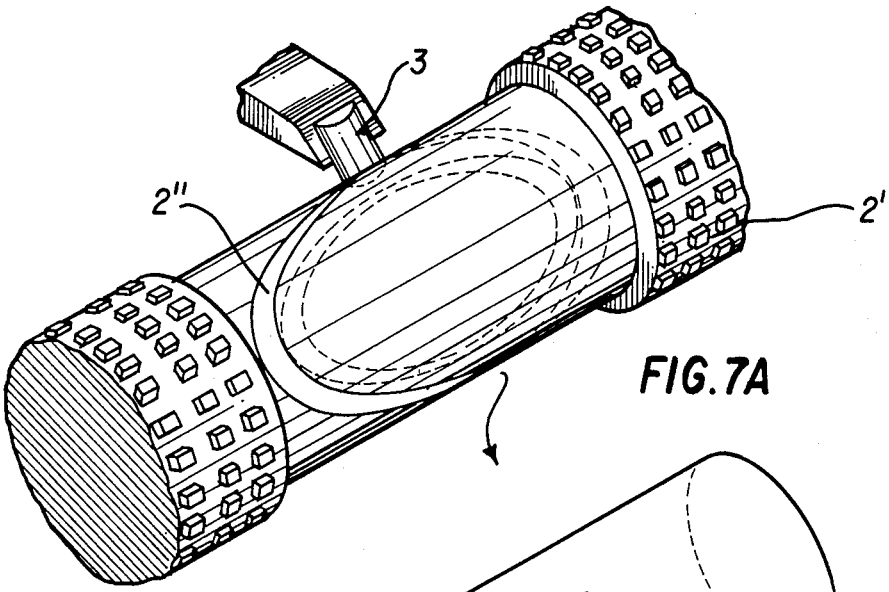
FIG. 7 is a perspective view showing the rotary element of FIG. 6 and also schematically showing the shape of a guiding groove in the same.
Figure 7B:
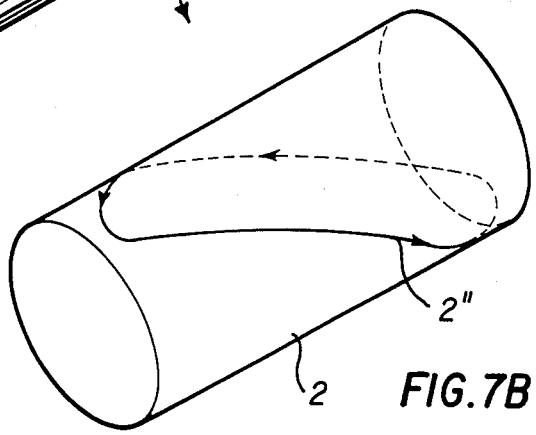

The rotary element 2 is provided with a shaded groove 2″ which can be formed as an endless groove as shown in FIGS. 6 and 7. The handle 5 or more particularly is transition portion 5″ is provided with a guiding pin 8 which engages in the groove 2″ of the rotary member 2.

During shaving a user the handle element 5 and therefore the head element 1 with the blades 1′ in a predetermined direction, for example in a substantially vertical direction downwardly. The rotary member 2 is pressed against a surface to be shaven and rotates because of the frictional contact with the latter. Since the pin 3 engages in the shaped groove 2″, the rotation of the rotary member 2 simultaneously causes its transverse displacement in an axial direction. This transverse displacement is transferred to the head element 1 as a result of the cooperation of the axial end surfaces of the rotary element 2 with the axial end surfaces of the projections 1″ of the head element 1. Therefore, the head element 1 together with the blades 1′ also performs, in addition to the movement imparted to the safety razor by a user, a transverse displacement in a direction which is transverse to the above movement.

The arrangement of the pins 7 and the springs 6 provides for easy mounting of the safety razor. This can be achieved by pressing the pins 7 completely into the recesses 2′ of the rotary member 2 and out of the openings 1‴ of the head element 1 and thereby disengaging the head element 1 from the rotary element 2.

Figure 2:
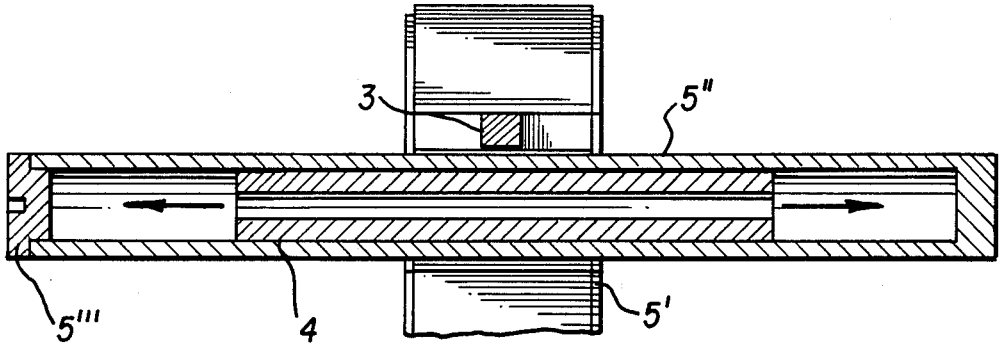
FIG. 2 is a view showing a section of the safety razor of FIG. 1, taken along the line A—A in FIG. 1.
Figure 3:
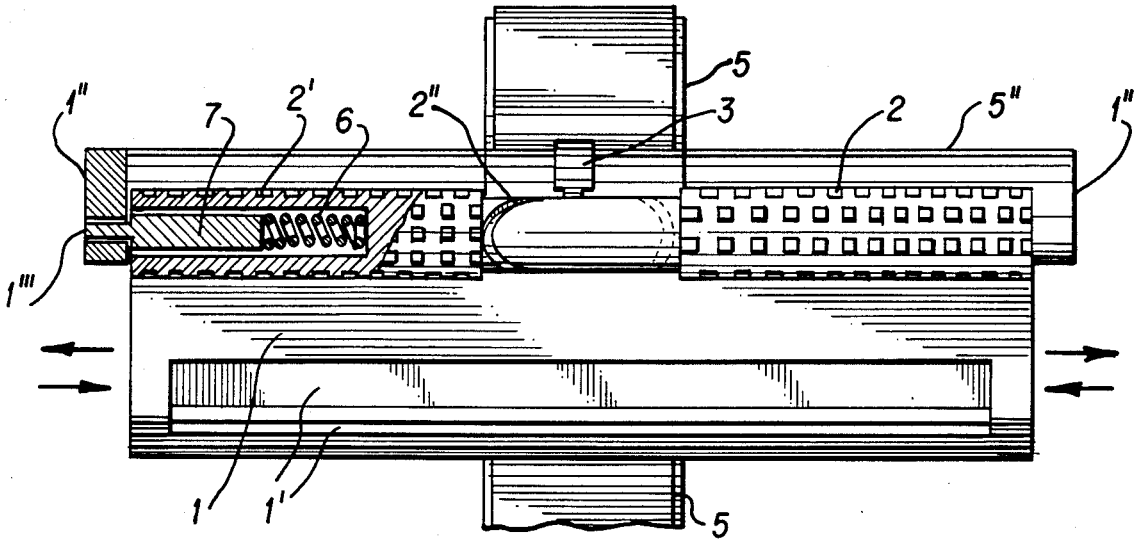
FIG. 3 is a front view of the safety razor of FIG. 1.
Figure 4A:
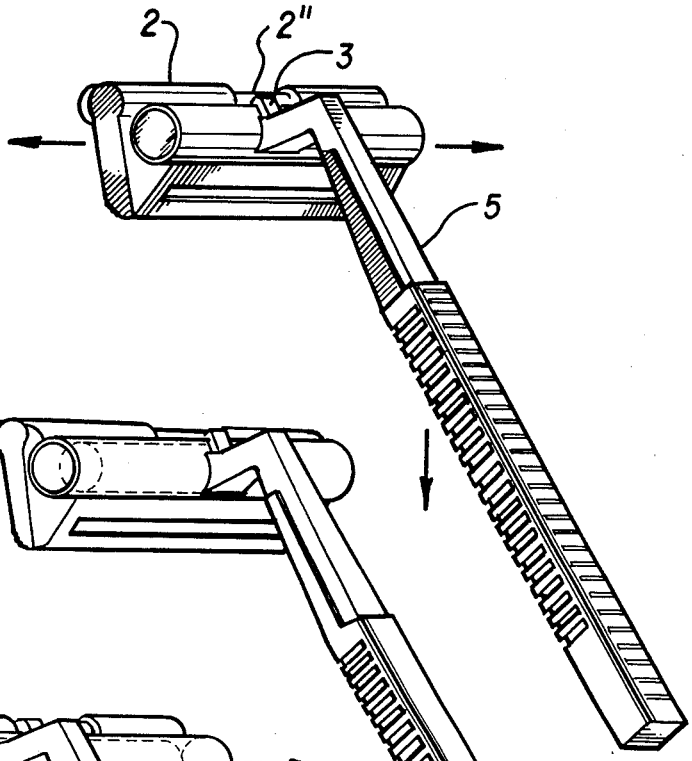
FIG. 4 shows the safety razor of the invention in which a blade carrying head element is in its central position, in its position displaced transversely to one side, and in its position displaced transversely to the other side, respectively.
Figure 4B:
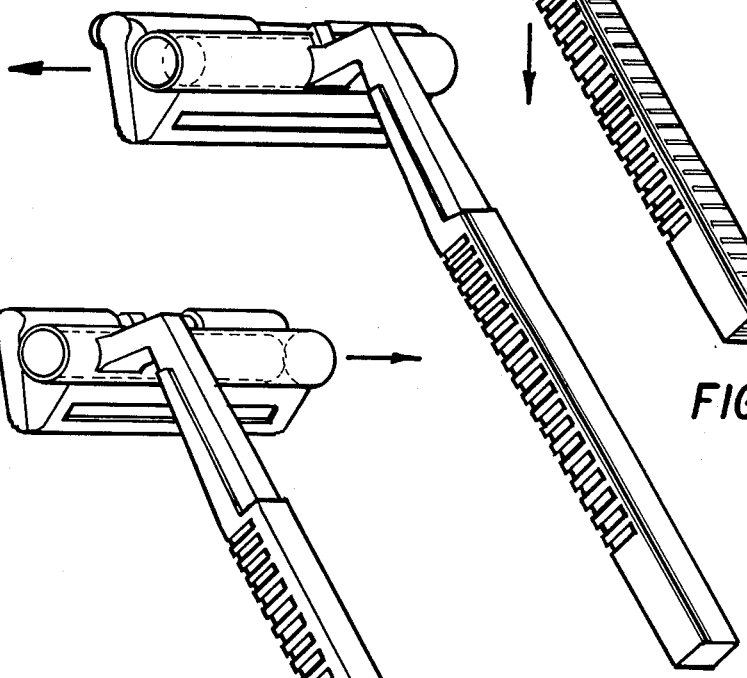
Figure 4C:
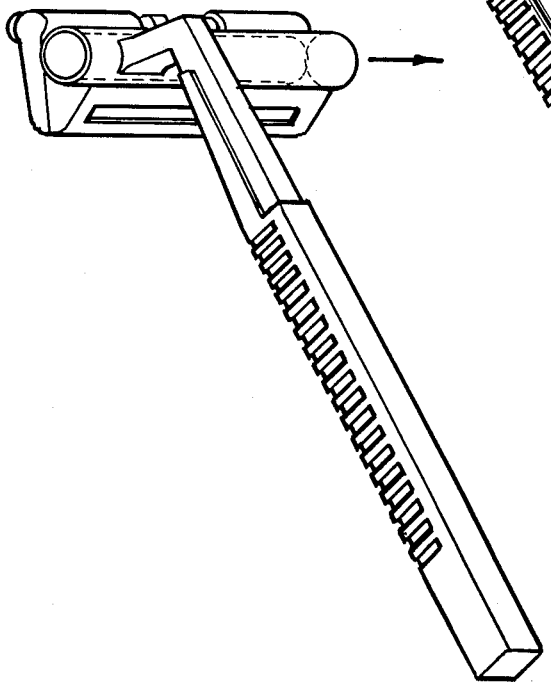
Figure 5:
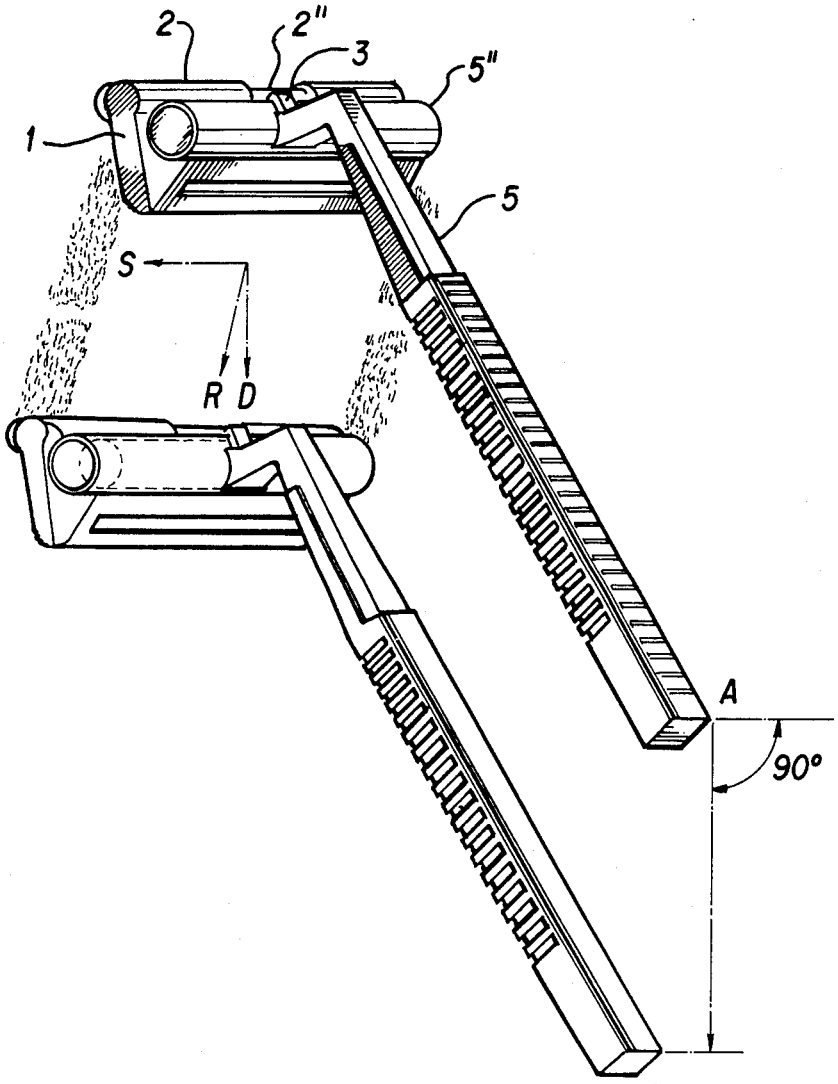
FIG. 5 is a view illustrating the shaving process and showing the inventive safety razor with the blade carrying head element in its central positin and in its displaced position, and also showing the components of a cutting force.

As mentioned hereinabove, the whole safety razor can be disposable. On the other hand, the blades 1′ can be disposable by removing them from the head element 1 and replacing with new blades. Finally, the head element 1 can be disposable by removing it from the handle element 5 and replacing with a new head element. In this case, in addition to the above described dismounting, the projection 4 of the head element 1 must be axially withdrawn from the recess 4′ of the handle 5 by opening of an end plug 5‴. While the transition portion 5‴ on FIG. 2 shown as closed at its two axial ends, it is to be understood that it can be open at these ends as well, for each removal of the head element 1.

The rotary element 2 can have an outer surface provided with formations which enhance its frictional contact with a surface to be shaven. As shown in the drawings, the outer surface of the rotary member is provided with a plurality of small projections and grooves. It is believed that other types of surface structure or texture can also be used to achieve the same results.

It will be understood that each of the elements described above, or two or more together, may also find a useful application in other types of constructions differing from the types described above.

While the invention has been illustrated and described as embodied in a safety razor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety razor, comprising a blade carrying head element which has at least one blade and a rotary member provided with a shaped groove and arranged to rotate in response to contact with a surface to be shaven during shaving; and a handle element provided with a projection which engages in said shaped groove of said rotary member of said head element so that when a user moves said handle element and therefore said head element in a predetermined direction during shaving, said head element together with said blade is displaced relative to said handle element in a direction relative to said handle element in a direction which is transverse to said predetermined direction in response to rotation of said rotary member, said head element having a body provided with two lateral projections spaced from one another in a transverse direction and adjacent respective ends of said rotary member, so as to engage and hold the latter.

2. A safety razor as defined in claim 1; and further comprising means for guiding said head element in said handle element during displacement in said transverse direction, said guiding means including a substantially cylindrical projection formed in said head element, and a substantially cylindrical guiding groove formed in said handle element and movably receiving said cylindrical projection.

3. A safety razor as defined in claim 2, wherein said rotary member is substantially cylindrical, said head element having a substantially cylindrical receiving groove arranged to receive said substantially cylindrical rotary member, said receiving groove and said rotary member having a first axis, said cylindrical projection and said guiding groove having a second axis, said first and second axes extending parallel to one another.

4. A safety razor, comprising a blade carrying head element which has at least one blade and a rotary member provided with a shaped groove and arranged to rotate in response to contact with a surface to be shaven during shaving; and a handle element provided with a projection which engages in said shaped groove of said rotary member of said head element so that when a user moves said handle and therefore said head element in a predetermined direction during shaving, said head element together with said blade is displaced relative to said handle element in a direction which is transverse to said predetermined direction in response to rotation of said rotary member, said rotary member having two spaced ends, said head element having a body provided with two lateral projections spaced from one another in a transverse direction and adjacent respective ends of said rotary member, so as to engage said ends of said rotary members and hold the latter; and means for releasably engaging each of said projections with each of said ends of said rotary member and including a recess provided in each of said ends of said rotary member, an opening provided in each of said projections of said head element, a pin engaging in each of said recesses and each of said openings, and a spring releasably holding said pin in said engagement in each of said recesses and each of said openings.

* * * * *